United States Patent [19]

Ramsey, Jr.

[11] Patent Number: 5,048,548

[45] Date of Patent: Sep. 17, 1991

[54] VAPOR CONTROL SYSTEM FOR VAPOR DEGREASING/DEFLUXING EQUIPMENT

[75] Inventor: Robert B. Ramsey, Jr., Wilmington, Del.

[73] Assignee: E. I. Du Pont de Nemours and Company, Wilmington, Del.

[21] Appl. No.: 480,606

[22] Filed: Feb. 15, 1990

[51] Int. Cl.[5] ..... B01D 5/00

[52] U.S. Cl. ..... 134/108; 134/105; 202/170

[58] Field of Search ..... 134/108, 105, 11, 12, 134/31, 40; 202/170; 34/73, 75, 78

[56] References Cited

U.S. PATENT DOCUMENTS

| | | | |
|---|---|---|---|
| 2,020,335 | 11/1935 | Savage | 87/6 |
| 2,090,192 | 8/1937 | Edhofer et al. | 87/6 |
| 2,650,085 | 8/1953 | Burnett | 266/19 |
| 2,816,065 | 12/1957 | Legler | 202/170 |
| 2,823,174 | 2/1958 | Pickett | 202/170 |
| 2,867,225 | 1/1959 | Zademach et al. | 134/108 |
| 3,106,928 | 10/1963 | Rand | 134/79 |
| 3,242,057 | 3/1966 | Talian et al. | 202/170 |
| 3,242,933 | 3/1966 | Huff | 134/68 |
| 3,375,177 | 3/1968 | Rand | 203/39 |
| 3,606,896 | 9/1971 | Holm | 174/79 |
| 4,029,517 | 6/1977 | Rand | 134/11 |
| 4,210,461 | 7/1980 | Moree et al. | 134/11 |
| 4,246,116 | 1/1981 | Cormack | 210/170 |
| 4,486,239 | 12/1984 | du Fresne | 134/11 |
| 4,973,387 | 11/1990 | Osterman et al. | 134/11 |

FOREIGN PATENT DOCUMENTS

| | | |
|---|---|---|
| 112484 | 7/1984 | European Pat. Off. . |
| 140090 | 5/1985 | European Pat. Off. . |
| 2083504 | 3/1982 | United Kingdom . |

OTHER PUBLICATIONS

"FREON® Cleaning Agents: Cleaning System Design," Du Pont Brochure, FS-30A, 1969.

"FREON® Solvent Production Cleaning Equipment", Du Pont Brochure, FS-27, 1986.

"The 'Cold Trap'", AutoSonics Inc. Brochure, PRE-1969.

"TRAP Solvent Vapors Cold . . . ", Dow Chemical Co. Brochure, 1969.

*Primary Examiner*—William A. Cuchlinski, Jr.
*Assistant Examiner*—William C. Dowling
*Attorney, Agent, or Firm*—Robert B. Stevenson

[57] ABSTRACT

An improved vapor degrease characterized by a deep freeboard zone (i.e., freeboard to width ratio of 1.0 to 2.3) containing a three-stage condenser/heat exchanger configuration comprising: a water-cooled lower primary exchanger operating above 32° F. to effect condensation of the bulk of the vapor generated by the boiling sump and a combination of an intermediate exchanger above, but preferably overlapping, the primary exchanger and a dehumidifying third exchanger position just below the top lip of the degreaser, both operating at a temperature below 32°F. (preferably +10° to −30°F.) to effect a reduction in the vapor concentration gradient that controls the rate of vapor diffusion through the freeboard zone. The improved vapor degreaser is particularly useful in reducing vapor losses when using low boiling solvents.

4 Claims, 5 Drawing Sheets

VAPOR CONTROL SYSTEM FOR VAPOR DEGREASING/DEFLUXING EQUIPMENT

BACKGROUND OF THE INVENTION

1. Field of the Invention

This invention relates to an improved solvent vapor control system for the minimization of emissions from vapor degreasing and defluxing equipment. More specifically, the invention relates to the use of multiple-stage condensing/heat exchanging within the freeboard region of a vapor degreaser to reduce vapor diffusional losses.

2. Description of the Prior Art Including Information Disclosed Under §§1.97–1.99

It is generally known and a common commercial practice to employ an organic solvent/cleaning agent in various types of vapor degreasing/defluxing equipment to clean articles of manufacture, deflux electronic circuit boards and the like. It is also generally known and a common commercial practice to employ various volatile organic solvents and, in particular, chlorofluorocarbons, CFCs, as the solvent of choice. However, it is now recognized that the escape of organic solvents and, in particular, the escape of certain CFCs to the atmosphere will potentially contribute to the depletion of the stratospheric ozone layer and contribute to the global warming phenomenon. In view of the above, certain hydrochlorofluorocarbons, HCFCs, and hydrofluorocarbons, HFCs, are now being considered as alternatives to the ozone-depleting CFC solvents. These alternatives are generally more expensive and more physiologically active than commonly used compounds and, in some instances, the proposed alternative compound is also highly volatile with a boiling point at or near room temperature. Consequently, the traditional incentives to reduce vapor losses because of cost and safety considerations are enhanced and of greater criticality when using a low boiling HFC or HCFC as the solvent.

Historically several methods of reducing vapor losses to the atmosphere when using a vapor degreaser have been proposed with varying degrees of success; however, no prior art reference appears to deal specifically with the diffusional losses associated with and caused by the vapor concentration gradient inherently present in the freeboard region of the vapor degreaser. For example, U.S. Pat. No. 2,090,192 uses a single cooling coil to condense vapors within an essentially totally enclosed unit, thus reducing vapor loss to the atmosphere by isolating the vapors from the air. In U.S. Pat. No. 2,816,065 a two-sump, open-top degreaser is disclosed wherein a single refrigerated condenser coil is used at effectively a lower temperature than normal to minimize vapor losses, but again not control of the vapor concentration gradient over the length of the freeboard zone is suggested to reduce diffusional losses.

Also several prior art disclosures have suggested the use of more than one cooling coil or heat exchanger for various reasons, but again, not specifically to reduce the vapor concentration gradient found in the freeboard region of the degreaser. For example, U.S. Pat. No. 2,000,335 suggests the use of two heat exchangers in series within the vapor degreaser. The first heat exchanger is immersed in the hot liquid solvent and is used to heat the water coolant such that the second condensation heat exchanger operates above the dew point preventing water condensation simultaneously with solvent recovery. U.S. Pat. No. 2,650,085 suggests the use of two different temperature cooling coils in a distillation process; however, the process is not a vapor degreaser but rather the distillation and recovery of calcium metal and an alkali metal. In U.S. Pat. No. 3,106,928, the problem of diffusional losses is recognized and the use of a small fan to recycle the vapor/air mixture above the condensing coil to a secondary, external condenser for further vapor condensation is disclosed. In U.S. Pat. Nos. 3,242,057 and 3,242,933 a pair of condenser/heat exchangers each operated at essentially the same temperature are used in a rotating drum and in a conveyer belt automated vapor degreaser system, respectively, wherein the second water-cooled condenser is located at the exit of the automated system.

In U.S. Pat. No. 3,375,177 an open-top vapor degreaser unit that employs a water-cooled primary condenser/heat exchanger to condense the vapors above the boiling sump and an additional refrigerated condenser/heat exchanger above the primary condenser to dehumidify and further reduce vapor loss is disclosed. Again, this reference is void of any suggestion or attempt to control the temperature profile throughout the freeboard zone, such as to reduce the vapor concentration gradient. As such, even this prior art vapor degreaser will exhibit significant vapor losses associated with vapor diffusion.

SUMMARY OF THE INVENTION

The present invention provides an improved multi-stage condenser/heat exchanger configuration within a conventional vapor degreaser and a novel method of operating such a configuration such as to simultaneously minimize cooling costs and minimize vapor loss. According to the present invention, at least three specific heat exchangers critically positioned at various depths in a vapor degreasing unit characterized by a deep freeboard (i.e., freeboard to width ratio of 1.0 to 2.3) are maintained at two different temperatures to optimize the vapor condensation and cooling process. A water-cooled lower primary exchanger operating at a temperature greater than 32° F. (0° C.) is used to effect the condensation of the bulk of the vapors generated by the boiling sump at minimal costs for coolant. A second intermediate exchanger located above the primary exchanger (but, preferably with some overlap with the primary exchanger) is operated at a temperature below 32° F. (typically +10° to −30° F.) to desolvantize the vapor/air atmosphere in the portion of the freeboard zone that exists at an elevation between the midpoint of the primary exchanger and the top of the secondary, intermediate exchanger. A third, upper exchanger, located above the other two exchangers and near the top of the degreaser freeboard zone below the top lip of the degreaser is operated at a temperature that is preferably within ±5° C. of the temperature of the intermediate exchanger to provide a dehumidified atmosphere of low water vapor content at the top of the degreaser's freeboard zone. The combination of the intermediate, relatively cold, exchanger and the upper dehumidifying exchanger produces a significant and unexpected reduction in the vapor concentration gradient that controls the rate of vapor diffusion through the freeboard zone. As such, the use of the improved multi-stage condenser/heat exchanger system of the present invention is particularly useful to reduce diffusional losses when using low temperature solvents.

Thus, the present invention provides in a vapor degreasing apparatus, wherein a cleaning solvent is maintained at reflux conditions for degreasing/defluxing an object, comprising a boiling sump for immersing the object to be cleaned, a vapor zone and a freeboard zone above the boiling sump with an associated first heat exchanger to condense the vapors generated by the boiling sump, and a clean solvent sump for collecting the condensed vapors, rinsing the cleaned object and replenishing the solvent in the boiling sump, the specific improvement comprising:

(a) a first condenser/heat exchanger means adapted to operate at a temperature below the dew point of the solvent vapor but above about 32° F. (0° C.) for condensing the vapors produced by the boiling sump;

(b) a second condenser/heat exchanger means adapted to operate at a temperature below 32° F. (0° C.) and located above the lowest portion of the first condenser/heat exchanger for further condensing vapors produced by the boiling sump;

(c) a third condenser/heat exchanger means adapted to operate at a temperature within about 5° C. of the temperature of the second condenser/heat exchanger means and located above the first and second condenser/heat exchanger means near the top of the freeboard zone for condensing water vapor; and (d) a means associated with the third condenser/heat exchanger means for isolating any condensed water or frost.

The novel process for recovering solvent vapors in a vapor degreasing apparatus, according to the present invention, comprises the steps of:

(a) subjecting vapors above a boiling solvent to a first heat exchanger cooling step at a temperature below the dew point of the solvent vapors but above 32° F. (0° C.);

(b) subjecting vapors above the location of the first heat exchanger step to a second heat exchanger step at a temperature below 32° F. (0° C.);

(c) subjecting vapors above the location of the second heat exchanger step to a third heat exchanger step at a temperature within about 5° C. of the temperature of the second heat exchanger step; and (d) isolating any recovered condensate produced from the third heat exchanger step such that it can be subjected to a drying step prior to being combined with condensate produced in the first and second heat exchanger steps.

It is an object of the present invention to provide an improved vapor degreaser that when used with a low boiling organic solvent and, in particular, low boiling halocarbons, the solvent losses associated with diffusion are significantly reduced. It is a further object of the present invention to accomplish the above by using a plurality of critically positioned condenser/heat exchangers in the freeboard zone of the degreaser such as to simultaneously condense the bulk of the vapors generated by the boiling sump economically by use of a water chilled primary exchanger and reduce the vapor concentration gradient associated with diffusion through the freeboard zone by use of a pair of refrigerant cooled exchangers. It is still further object of the present invention to reduce the water vapor concentration entering the freeboard zone such as to further reduce vapor diffusional losses by having one of the refrigerant cooled exchangers be located below the lip of the degreaser at the top of the freeboard zone. Fulfillment of these objects and the presence and fulfillment of additional objects will be apparent upon complete reading of the specification and claims taken in combination with the attached drawings.

DESCRIPTION OF THE PREFERRED EMBODIMENTS

Figure 1:
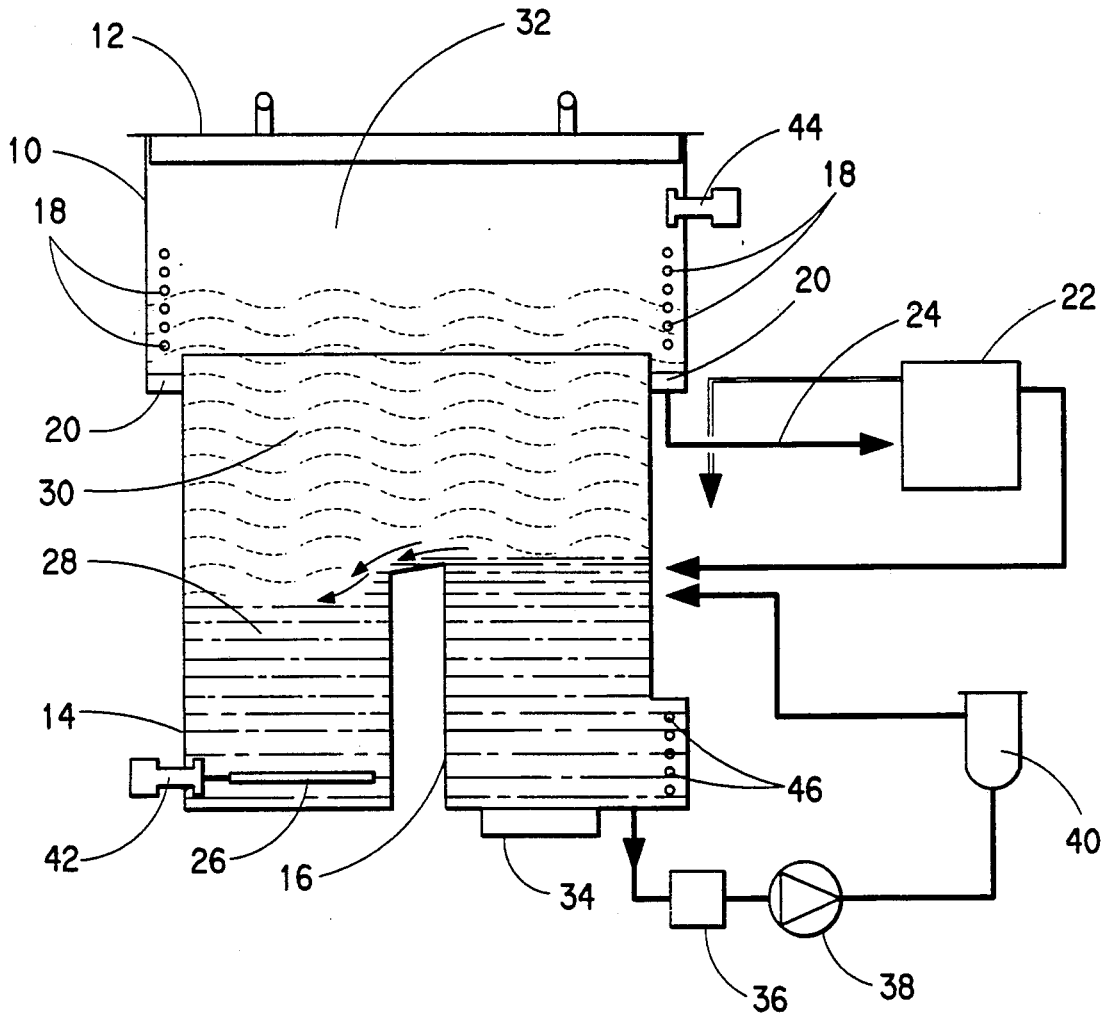
FIG. 1 (PRIOR ART)
FIG. 1 is a schematic cross-section view of a typical two-sump, open-top degreaser as known and commercially practiced in the prior art.

The improved equipment and method of minimizing diffusional losses from a vapor degreasing/defluxing unit according to the present invention, how the modifications are incorporated into a conventional prior art degreaser and how the present invention differs from the prior art as well as the advantages associated with its use can perhaps be best explained and understood by reference to the drawings. Generally, halogenated organic solvents/cleaning agents are used in degreasing/defluxing equipment that can be configured in a variety of ways. To a great extent, all such equipment configurations are based on fundamental concepts employed in a prior art device commonly referred to as a conventional two-sump, open-top degreaser. FIG. 1 of the drawings illustrates such a prior art degreaser.

Typically, the degreaser will involve an open-top tank 10 covered by an optional lid 12 wherein at least one heated sump 14 generates solvent vapors (thus the term "vapor generator" or "boiling sump") and one or more rinse sumps 16 arranged in an overflowing cascaded relationship (see arrow) to the heated sump 14. In the broadest sense of the present invention, the presence of the rinse sump 16 is optional as previously shown when describing prior art references. However, contemporary vapor degreaser/defluxing equipment usually employs at least one rinse sump or the equivalent for reasons that will be apparent upon explaining how such a device is to be used. The tank 12 of the prior art device will have a condensing coil (heat exchanger) 18 appropriately located above the boiling solvent in the sump 14, to cool and condense solvent vapors back into liquid form. A trough 20 under the condenser/heat exchanger 18 collects the condensate. A water separator or desiccant dryer 22 is used to remove water from the condensate being delivered from trough 20 via line 24 before the dry condensate is returned to the rinse (or cleaning) sump 16.

During use, heater 26 supplies energy to the liquid solvent/cleaning agent 28 in the boiling sump 14 such that a vapor zone 30, rich in solvent vapors, is maintained between the surface of the liquid in the various sumps and approximately at the vertical midpoint of the condensing coil 18. In other words, such equipment is typically designed and operated such that the vapor/air interface is about half way up the vapor condensing coils. The region or space directly above the vapor/air interface is referred to as the freeboard zone 32 and traditionally has been quantitatively characterized as the vertical distance from the midpoint of the condenser 18 (i.e., top of the vapor zone) to the top edge of the tank 12. It is also generally accepted and known in the art that the ratio of this freeboard dimension (i.e., the height over the refluxing vapor phase) to the smallest horizontal tank dimension (the so-called "freeboard/-width ratio") affects diffusional losses and in prior art devices should be at least 0.75 up to about 1.0.

Typically the prior art device will be further equipped with one or more ultrasonic transducers 34 to facilitate the cleaning of an object immersed in the liquid phase of a sump (in this illustrated embodiment the cleaning agent rinse sump 16). The rinse sump 16 is also equipped with an external recycle liquid cleaning loop involving a strainer 36, pump 38 and filter 40 for removing particulate material freed during ultrasonic liquid immersion of the cleaned/defluxed article. A low liquid level and high solvent temperature safety controller 42 is present in the boiling sump 14 while a high vapor level and safety thermostat 44 is provided at the top of the condensing coil 18 in the freeboard zone 32. The liquid sump 16 is further equipped with a cooling coil 46 that can be used to lower the temperature of the liquid and thus reduce evaporation losses particularly during periods of not using the equipment.

Figure 2:
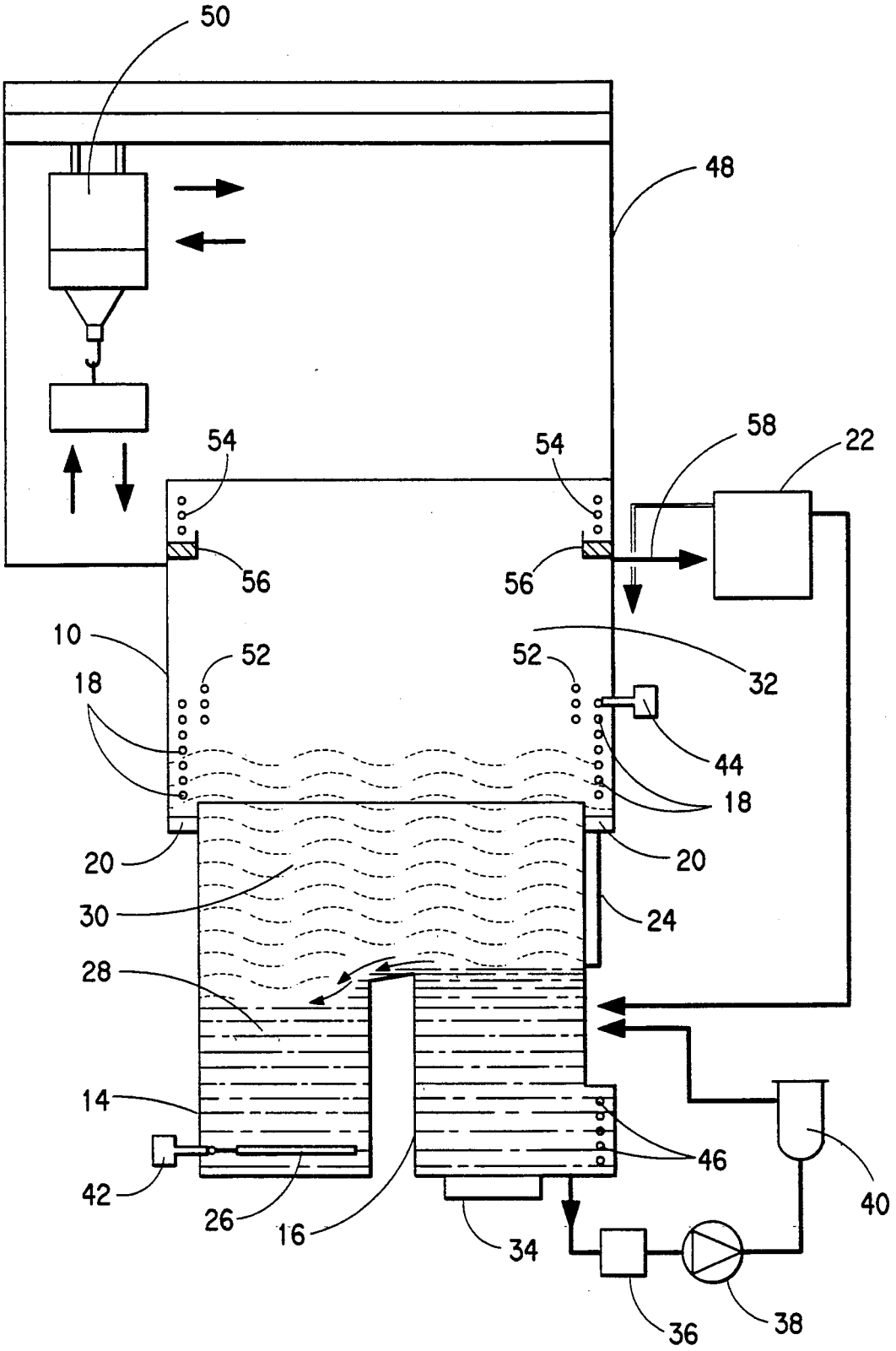
FIG. 2 is a schematic cross-sectional view of an improved two-sump, open-top degreaser with hooded work transporter according to the present invention.

In contrast to the prior art device depicted in FIG. 1, FIG. 2 illustrates a two-sump degreaser equipped with additional condenser/heat exchangers according to the present invention. In describing this particular embodiment, wherever possible the same number as used in FIG. 1 is employed in FIG. 2 to identify the identical or equivalent element or component. Thus, the illustrated embodiment of FIG. 2 includes a tank 10 with a boiling sump 14 and cascaded rinse sump 16 with a primary condensing coil 18 used to condense vapors 30, thus defining a vapor to air interface about half way up the cooling coil 18 which in turn defines the freeboard zone 32. Instead of providing a lid on the otherwise open-top degreaser, a hood 48 and programmable work transporter 50, as generally known in the art, is present. The use of such a work transporter will minimize dragout/-workload movement losses by eliminating the human factor and thus more accurately control the rate needed to minimize vapor/air disturbances, also as generally known. In a manner analogous to FIG. 1, the embodiment of FIG. 2 also contains a heater 26 in the boiling sump 14, an ultrasonic transducer 34 on the rinse sump 16, cooling coils 46 within the rinse sump 16, and a condensate recycle loop involving a strainer 36, pump 38 and filter 40 external to the rinse sump 16. Also, the safety controls 42 for monitoring low liquid level and high solvent temperature in the boiling sump 14 and safety thermostat 44 for monitoring high vapor level in the freeboard zone 32 are provided.

In addition to the water-chilled primary condensing coil 18, an intermediate refrigerated cooling coil 52 is located just above the primary cooling coil 18 with some overlap vertically with the top few coils of the primary condenser 18. Near the top of the freeboard zone 32 is a third condenser/heat exchanger 54 which is also refrigerant operated (refrigeration unit not shown). In other words, in addition to the primary condenser 18 which is typically operated at about 40° to 50° F. (4.4° to 10° C.), a second heat exchanger 52, to be operated below 32° F. (0° C.), is present in the lower region of the freeboard zone 32. It is the temperature of this particular heat exchanger that will establish the equilibrium vapor pressure of the volatile solvent in the lower regions of the freeboard zone 32. This is true independent of the fact that the water-chilled primary coil 18 and its associated relatively higher temperature essentially determines the vapor/air interface and furthermore will be the heat exchanger that is responsible for the bulk of the condensing of the volatile solvent. Associated with the third condenser/heat exchanger 54 is a condensate trough 56. Since heat exchanger 54 refrigerated (operates below 32° F.), any moisture or water vapor associated with the intrusion of air will tend to preferentially condense on this cooling coil 54 as opposed to condensing on condensers 52 or 18. Consequently, any frosting and liquid water condensate from trough 56 will be directed to the water separator or desiccant dryer 22 via line 58 before being returned to the clean rinse sump 16. Also, the condensate formed in trough 20 below primary condenser 18 should be relatively free of water and can be returned directly to sump 16 via line 24. Optionally, the condensate from trough 20 could also be processed through a drying stage if necessary (not shown).

As can be further seen in comparing FIGS. 1 and 2, the freeboard region or zone for the improved vapor degreaser according to the present invention is deeper than the conventional freeboard zone. More specifically, the freeboard/width ratio appropriate for the present invention is preferably greater than 1.0 and can be as high as about 2.3. Also, the relative placement of the respective three heat exchangers is viewed as being critical for vapor condensation and cooling purposes to control and minimize vapor emissions. The three heat exchangers according to the present invention are to be operated at, at least, two different temperatures.

The lower primary heat exchanger is operated at above water freezing temperature (i.e., greater than 32° F.) to effect the condensation of the bulk of the vapors generated in the apparatus. Since the temperature is above 32° F. (preferably 40°-50° F.), chilled water is the preferred coolant. Consequently, the operating cost for coolant as well as a capital costs for condensing the bulk of the vapor is (or can be) minimized, particularly relative to the alternative of allowing the refrigerated heat exchanger to perform a greater portion of the required cooling.

The second intermediate condenser/heat exchanger located above the primary exchanger, but, with preferably some overlap of its bottom cooling surfaces with the upper cooling surfaces of the primary exchanger, is to be operated at a temperature below the freezing point of water. Preferably, the intermediate heat exchanger is operated at about +10° to −30° F. (−23° to −34° C.). Because of this lower than normal temperature, a refrigerant must be employed to desolventize the vapor/air atmosphere. This lower than normal temperature near the vapor to air interface associated with the lower portion of the freeboard zone is viewed as being essential in that it is this temperature that dictates the vapor pressure of the solvent and, hence, the ultimate lowering of the vapor concentration gradient in the freeboard zone. The use of primary water chilled exchanger to effect the bulk of the condensing further conserves the operating and capital costs associated with the intermediate heat exchanger operation.

The third, upper heat exchanger, located above the other two aforementioned exchangers, near the top of the degreaser's freeboard zone, with its upper cooling surfaces located at 1 to 12 inches below the top lip of the degreaser, is also to be refrigerated and operated at a temperature preferably within about 5° C. of the temperature of the intermediate exchanger. As such, the third heat exchanger will preferentially function as the dehumidifying surface selectively removing water at the top of the freeboard zone. Of course, the presence of the cold condensing surface at the top of the freeboard zone as well as at the bottom (i.e., the intermediate exchanger) also ensures a consistently low temperature profile throughout the entire freeboard zone. This, in turn, results in a significant and unexpected reduction in the vapor concentration gradient that controls the rate of vapor diffusion through the freeboard zone. The fact that the moisture intrusion into the freeboard zone is controlled by the upper heat exchanger, enhances the efficiency of the intermediate exchanger in that frost will not form at the intermediate exchanger. Also, the frost and water condensate formed at the upper exchanger means that only the upper exchanger has to be periodically defrosted and all water entrainment will inherently occur at a location separate from where the bulk of the refluxing and condensation of organic vapors is occurring. Thus, the condensate generated by the lower two cooling coils will be collected in a trough or drip pan located at an elevation below the bottom surface of the primary heat exchanger. This condensate, relatively free of moisture can be returned directly to the degreaser's clean solvent sump.

The following examples are presented to further illustrate specific embodiments of the present invention. In performing these examples, the experimental observations and associated data resulted from the use of a two-sump, open-top vapor degreaser, as generally shown in FIG. 2, with a top opening 36 inches long and 12 inches wide. The particular degreaser employed in the examples was equipped with a liquid-cooled tubular condenser normally cooled with chilled water (i.e., 45° to 50° F.) supplied by a central chilled water circulation system. Provisions were incorporated into the degreaser for the addition of stainless steel sheet metal collars at the top of the degreaser to vary the depth of the freeboard zone and to facilitate the installation of additional heat exchangers in the freeboard zone. A self-contained portable chiller was installed to permit coolant to be supplied to the additional heat exchangers at a temperature ranging from −20° F. to 20° F.

Trichlorofluoromethane, $CCl_3F$ (CFC-11), was employed as the degreaser operating fluid (i.e., the volatile solvent/cleaning agent). Since trichlorofluoromethane is a low boiling point, 74.9° F. (23.8° C.), chlorofluorocarbon, the results are felt to be characteristic of similar relatively volatile alternative halocarbon solvents such as HCFC-123 (boiling point 82.2° F.) and HCFC-141b (boiling point 89.6° F.). Because of its lower boiling point, CFC-11 is a more difficult fluid to contain in a vapor degreaser and from that standpoint is a good test fluid for employment in containment tests. Conformation of the experimental results associated with CFC-11 has been carried out with solvent mixtures of HCFC-123 and HCFC-141b containing up to 2.5 volume percent methanol (proposed solvent candidates for defluxing and metal cleaning applications).

EXAMPLE 1

Figure 3:
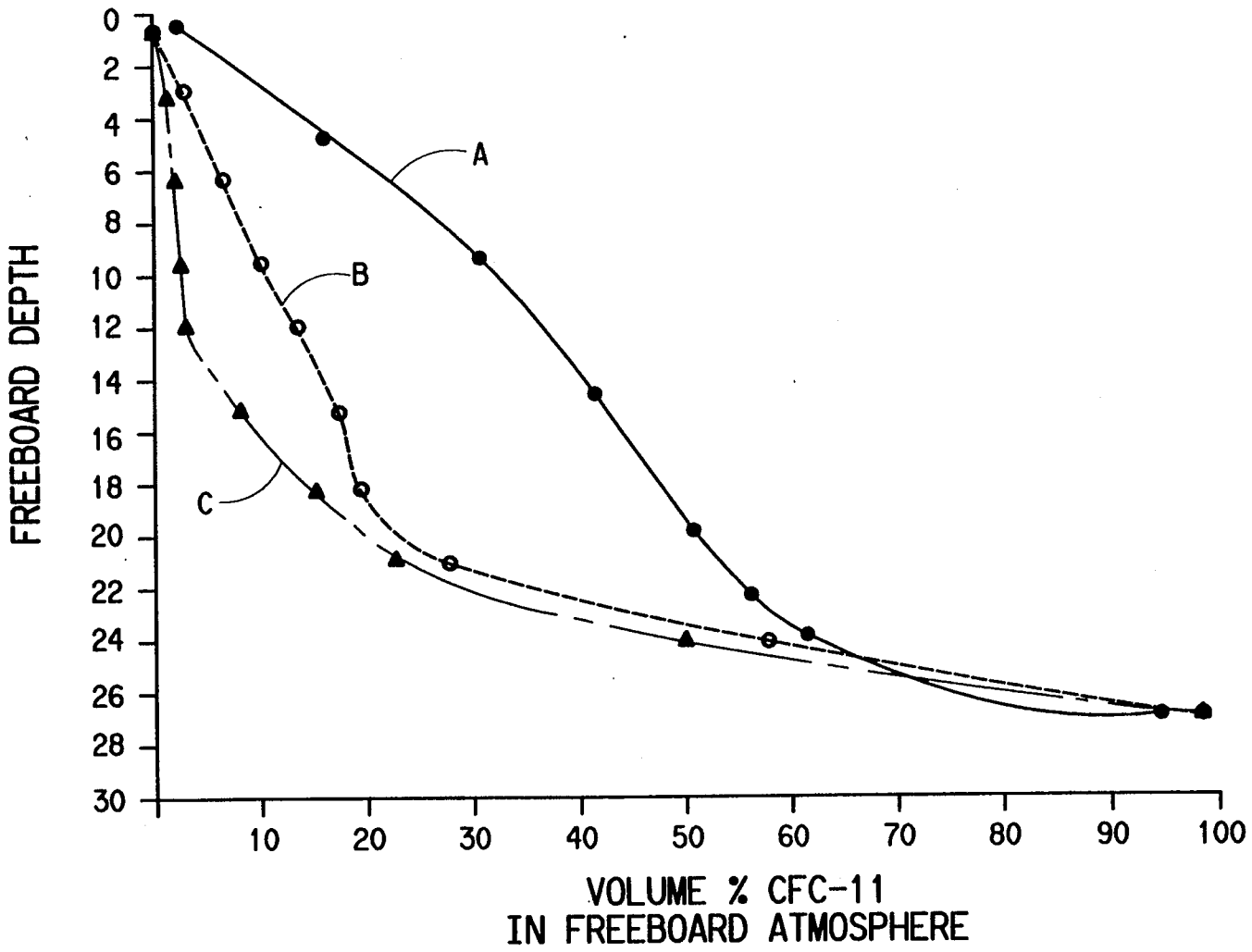
FIG. 3 is a plot of volume percent of $CCl_3F$, CFC-11, in the freeboard atmosphere as a function of depth in inches down from the top lip of the degreaser for three different condenser/heat exchanger configurations involving a different number of condensers being present in each curve being plotted.

Using a two-sump, open-top vapor degreaser as described above and as essentially illustrated in FIG. 2, a series of three comparative runs were performed. One run involved the use of the primary condenser only operated at an average temperature of 47.5° F. The second run involved the primary condenser operated at an average temperature of 47.6° F. with the intermediate condenser operating at an average temperature of 1.0° F. In the third run the primary condenser was maintained at 46.3° F., the intermediate condenser was at −0.5° F. and the third dehumidification coil was operated at −0.1° F. In each run equilibrium refluxing conditions were established and then samples of the gaseous atmosphere at various depths of the freeboard zone were collected in evacuated metal cylinders via a capillary sampling tube. The samples were then analyzed for their air and solvent vapor content by gas chromatography. The resulting data are plotted in FIG. 3 of the drawings; wherein A represents a primary condenser only @ 47.5'F, B represents a primary condenser @ 47.6'F with secondary condenser overlap @ 1'F, and C represents a primary condenser @ 46.3'F with secondary condenser overlap @ −0.5'F and dehumidifying coil @ −0.1'F.

From Fick's law of molecular diffusion, it is known that the rate of degreaser fluid vapor diffusion from the degreaser will be proportional to the compositional gradient that exists along the diffusional path (the freeboard depth). Therefore, the areas under the curves labeled A, B and C are measures of the relative loss rates encountered under the three conditions of operation. Operation at the conditions of Curve C, which has the smallest area under it, yields the lowest loss rate. The improvement in employing the secondary overlapping condenser in conjunction with a primary condenser operating at a temperature of 45°-55° F. is represented by the area existing between Curves A and B, and the further improvement brought about by the addition of the third exchanger near the top lip of the degreaser is represented by the area existing between Curves B and C.

From the above data it can be concluded that there is a beneficial reduction in vapor diffusion associated with the employment of first, a low temperature overlapping exchanger in combination with a conventional primary condenser operating at 45°-50° F., and then subsequently providing a third, low temperature, dehumidifying heat exchanger near the top lip of the degreaser produced an additional beneficial reduction in vapor diffusion.

EXAMPLE 2

Figure 4:
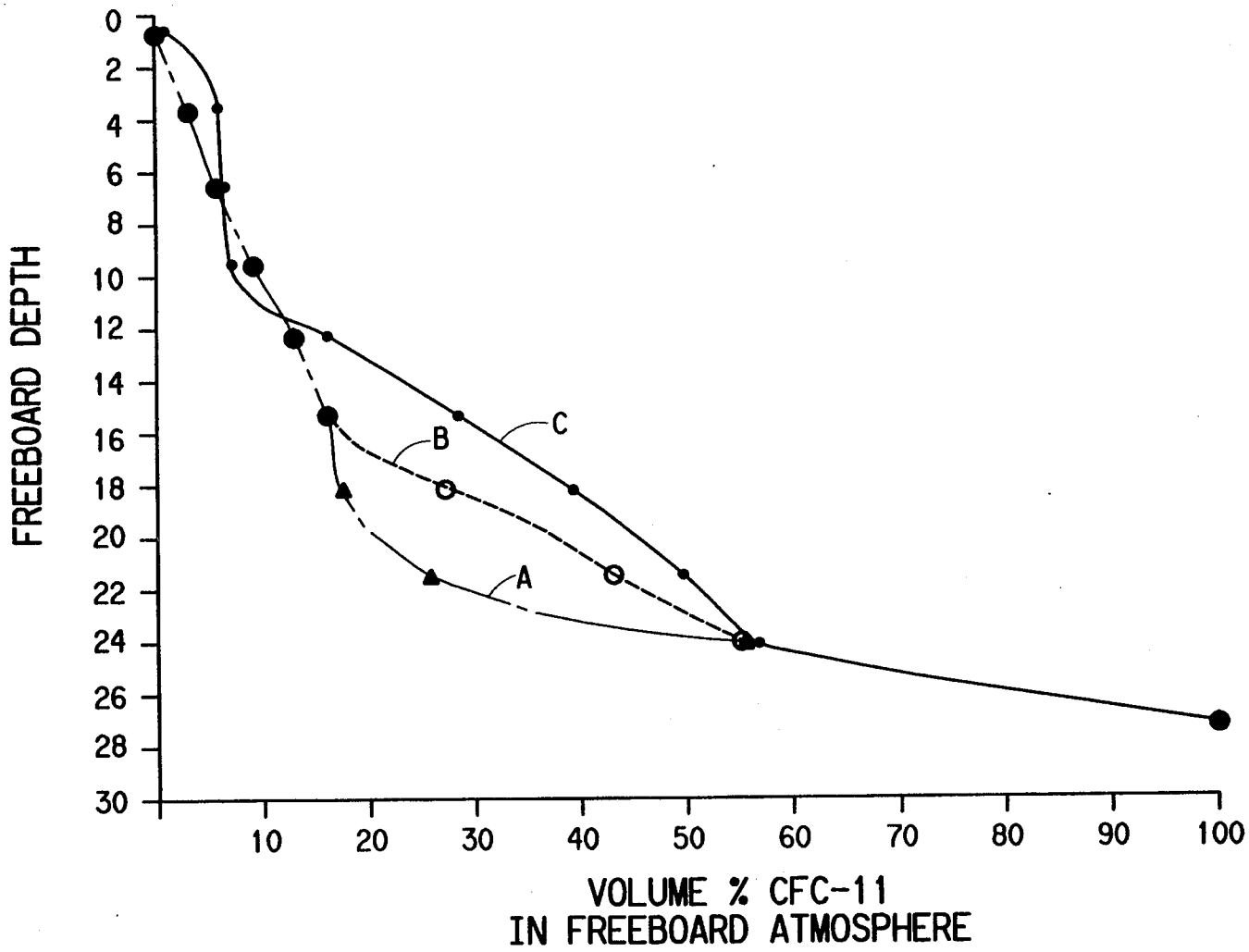
FIG. 4 is a plot of volume percent of $CCl_3F$, CFC-11, in the freeboard atmosphere as a function of depth in inches down from the top lip of the degreaser for three different condenser/heat exchanger configurations involving a primary condenser and a secondary condenser with the location of the secondary condenser differing in each curve being plotted.

In a manner analogous to Example 1, a series of two additional runs were performed and the resulting data are plotted along with one of the previous runs of Example 1 as FIG. 4 of the drawings. Curve A involves the primary condenser operating at a temperature of 47.6° F. with the intermediate condenser overlapping with the primary condenser and being operated at 1.0°

F. Curve A of FIG. 4 is the same as Curve B of FIG. 3. Curve B of FIG. 4 involves the primary condenser operating at a temperature of 45.5° F. and the intermediate condenser operating at −0.8° F. without any overlap of the heat exchangers (i.e., the intermediate heat exchanger was located immediately above the primary). Curve C of FIG. 4 involves the primary condenser operating at a temperature of 46.3° F. and the second (intermediate) heat exchanger being repositioned only 2.5 to 3 inches below the top lip of the degreaser and being operated at 1.5° F.

From the above data it can be seen that the physical placement of the secondary intermediate heat exchanger in reference to the primary condenser is significant in controlling diffusional losses with some overlap being particularly preferred.

EXAMPLE 3

Figure 5:
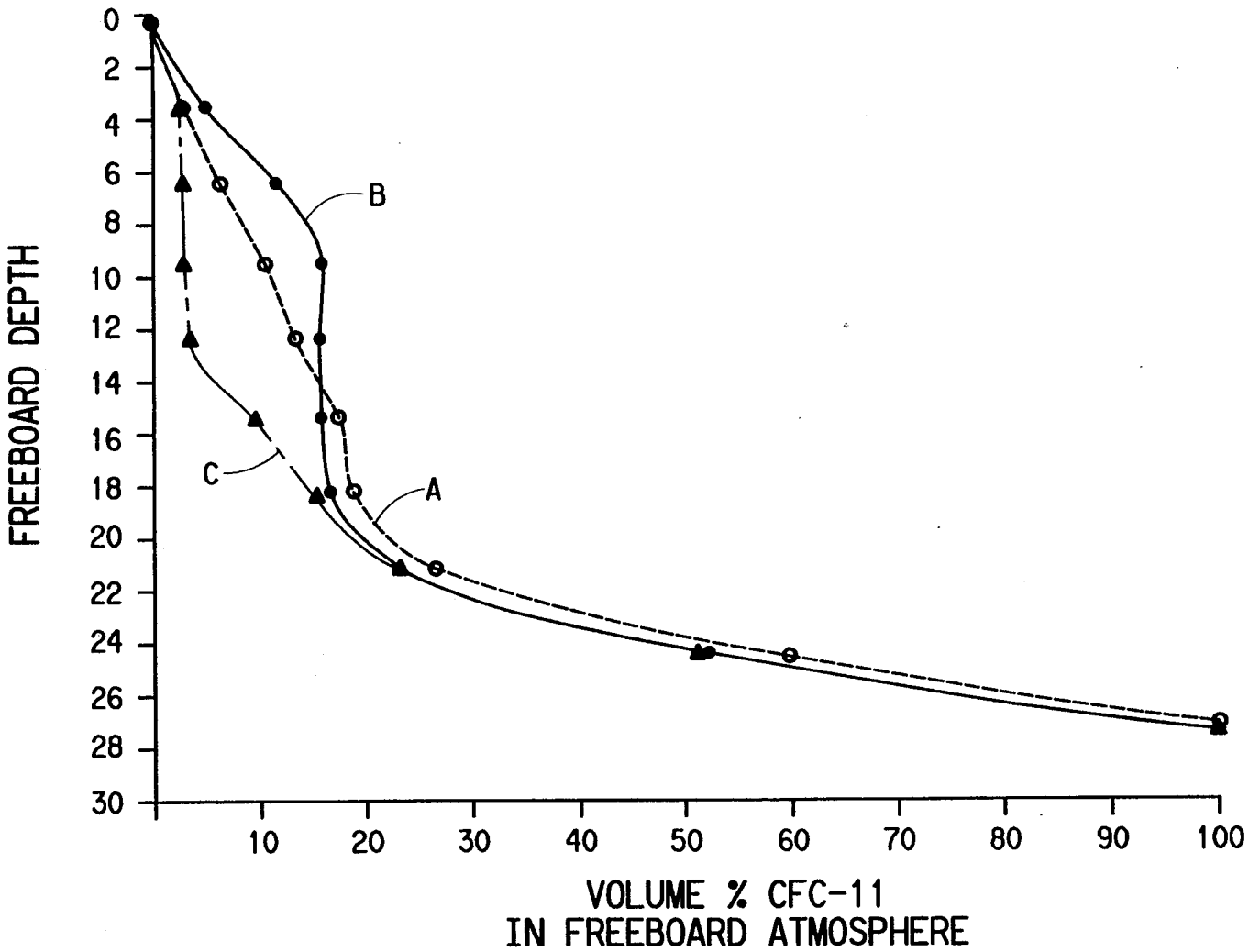
FIG. 5 is a plot of volume percent of $CCl_3F$, CFC-11, in the freeboard atmosphere as a function of depth in inches down from the top lip of the degreaser for three different condenser/heat exchanger configurations involving a different location for the third stage, dehumidifying heat exchanger in each curve being plotted.

In a manner analogous to the previous two examples and using the same equipment, an additional run was performed with the dehumidifying heat exchanger positioned 8¼ inches from the top lip of the degreaser. In this run the primary condenser was operated at 49.2° F. and the overlapping intermediate condenser was operated at 0.8° F. The third dehumidifying condenser was maintained at 1.2° F. The results of this run are plotted as Curve B in FIG. 5. Curve A of FIG. 5 is the Curve A of FIG. 4 (i.e., Curve B of FIG. 1) representing overlapping primary and intermediate condensers with no dehumidifying condenser. Curve C of FIG. 5 is Curve C of FIG. 3 and represents all three condensers in their optimum relative positioning. As seen from FIG. 5, the proper physical placement of the upper dehumidifying exchanger in respect to the overlapping primary and secondary heat exchangers plays a role in controlling diffusional losses.

The advantages of the present invention are considered numerous and significant. First and foremost, the equipment necessary to implement the improved process according to the present invention can be readily incorporated into virtually any type of conventional vapor degreaser as generally known in the art and, once incorporated, can be used to minimize emissions associated with the use of low boiling solvents. As such, the present invention is particularly useful when employing ozone-depleting CFC solvents as vapor degreasing solvents as well as the proposed HCFC and HFC alternative solvent systems. The improved method of the present invention is viewed as being economical in that by properly selecting the relative size and position of the respective condenser/heat exchangers such that most of the organic vapor produced in the boiling sump is cooled by the first cold water condenser, the overall capital costs and power cost associated with the low temperature condensers is minimized. The improved method is viewed as being relatively safe in that it can be incorporated into existing systems and methods without substantially changing the equipment or manipulative steps of the conventional process. And finally, by properly selecting the respective relative positions and temperatures of the three heat exchangers and in particular the proper use of the dehumidifying condenser, the loss of organic solvent attributed to diffusion can be substantially reduced.

It should be appreciated that the multiple-stage heat exchanger concept for vapor condensation according to the present invention can be readily incorporated into other vapor degreaser equipment than that illustrated as generally known in the art without departing from the scope and essence of the present invention. Furthermore, it is contemplated that various other elements and stages can be readily included in the embodiments illustrated again without department from the scope and essence of the present invention. For example, but not by way of limitation, the simple two-sump, open-top degreaser illustrated in FIG. 2 can equally be a three-sump or multiple-sump degreaser as generally known in the art wherein one or more of a series of cascaded intermediate rinse sumps are positioned between the primary cleaning agent boiling sump (i.e., the vapor generator) and the cleaning agent rinse sump (i.e., the condensate reservoir), thus effecting multiple-stages of cleaning/rinsing with sequentially higher purity liquid solvent. Also, it is contemplated that a super heated drying stage/chamber can be incorporated as a final stage again as generally known in the art, thus facilitating part drying and further eliminating vapor losses.

The multiple-stage heat exchanger concept of the present invention can also be incorporated into continuous vapor degreaser equipment and as such the invention is not limited to batch-wise equipment as illustrated in the drawing. Thus, the improved three condenser/-heat exchangers according to the present invention can be readily incorporated into the monorail conveyor system, the meshed belt conveyor system or the cross rod conveyor system as commercially used in vapor cleaning equipment and processes. In the case of a belt defluxer with the inlet and exit tunnels at an angle, so that the diffusion occurs along an inclined path instead of strictly vertical, preferably the dehumidifying condenser is located up to about 12 inches from the top of the freeboard zone. In such an embodiment the temperature of the dehumidifying condenser is preferably operated at about 2° to 5° C. higher than the temperature of the intermediated condenser. As previously mentioned and illustrated, the improvement according to the present invention can also be used advantageously in programmed vertical lift systems, in-line lift and indexing systems, as well as manual open-top batch systems. And, again as previously mentioned, the improved process of the present invention can be advantageously employed with other ancillary steps including, but not limited to, the use of ultrasonics, ancillary solvent drying and/or distillation recovery as well as solvent extraction or the like.

Having thus described and exemplified the invention with a certain degree of specificity, it should be appreciated that the following claims are not to be so limited but are to be afforded a scope commensurate with the wording of each element of the claims and equivalents thereof.

I claim:

1. In a vapor degreasing apparatus, wherein a cleaning solvent is maintained at reflux conditions for degreasing/defluxing an object, comprising a boiling sump for immersing the object to be cleaned, a vapor zone and a freeboard zone above the boiling sump with an associated first heat exchanger to condense the vapors generated by the boiling sump, and a clean solvent sump for collecting the condensed vapors, rinsing the cleaned object and replenishing the solvent in the boiling sump, the specific improvement comprising:

(a) a first condenser/heat exchanger means adapted to operate at a temperature below the dew point of the solvent vapor but above about 32° F. (0° C.) for condensing the vapors produced by the boiling sump;

(b) a second condenser/heat exchanger means adapted to operate at a temperature below 32° F. (0° C.) and located above the lowest portion of the first condenser/heat exchanger for further condensing vapors produced by the boiling sump;

(c) a third condenser/heat exchanger means adapted to operate at a temperature within about 5° C. of the temperatures of the second condenser/heat exchanger means and located above the first and second condenser/heat exchanger means near the top of the freeboard zone for condensing water vapor; and (d) a means associated with the third condenser/heat exchanger means for isolating any condensed water or frost.

2. An improved degreasing apparatus of claim 1 wherein said second condenser/heat exchanger means is positioned at a level that at least partially overlaps with the level of said first condenser/heat exchanger means.

3. An improved degreasing apparatus of claims 1 or 2 wherein the depth of freeboard to width ratio is from about 1.0 to about 2.3.

4. An improved degreasing apparatus of claim 3 wherein said third condenser/heat exchanger means is from about 1.0 to about 12 inches below the top lip of the vapor degreasing apparatus.

* * * * *